US010138765B2

(12) United States Patent
Jang et al.

(10) Patent No.: US 10,138,765 B2
(45) Date of Patent: Nov. 27, 2018

(54) CONTROL VALVE FOR VALVE TIMING ADJUSTING DEVICE OF INTERNAL COMBUSTION ENGINE

(71) Applicants: Hyundai Motor Company, Seoul (KR); KIA Motors Corporation, Seoul (KR); Delphi Powertrain Systems Korea Ltd., Changwon-si, Gyeongsangnam-do (KR); Pine Engineering Ltd., Changwon-si, Gyeongsangnam-do (KR)

(72) Inventors: Koun Young Jang, Changwon-si (KR); Sung Dae Kim, Changwon-si (KR); Sang Ho Lee, Changwon-si (KR); Jae Young Kang, Changwon-si (KR); Sung Hoon Baek, Gimhae-si (KR); Soo Deok Ahn, Changwon-si (KR)

(73) Assignees: HYUNDAI MOTOR COMPANY, Seoul (KR); KIA MOTORS CORPORATION, Seoul (KR); DELPHI POWERTRAIN SYSTEMS KOREA LTD., Changwon-si, Gyeongsangnam-Do (KR); PINE ENGINEERING LTD., Changwon-si, Gyeongsangnam-Do (KR)

( * ) Notice: Subject to any disclaimer, the term of this patent is extended or adjusted under 35 U.S.C. 154(b) by 168 days.

(21) Appl. No.: 15/423,237

(22) Filed: Feb. 2, 2017

(65) Prior Publication Data

US 2017/0226902 A1 Aug. 10, 2017

(30) Foreign Application Priority Data

Feb. 5, 2016 (KR) ..... 10-2016-0014902

(51) Int. Cl.
*F01L 1/344* (2006.01)
*F01L 1/047* (2006.01)
*F01L 1/46* (2006.01)

(52) U.S. Cl.
CPC ..... *F01L 1/3442* (2013.01); *F01L 1/047* (2013.01); *F01L 1/46* (2013.01);
(Continued)

(58) Field of Classification Search
CPC ..... F01L 2001/3443; F01L 2001/34433; F01L 2001/34453; F01L 2001/34483; F01L 1/46
(Continued)

(56) References Cited

U.S. PATENT DOCUMENTS 6,276,322 B1 8/2001 Sekiya et al.
2012/0000437 A1 1/2012 Ozawa et al.
(Continued)

FOREIGN PATENT DOCUMENTS

JP H09-324613 A 12/1997
JP H11-062521 A 3/1999
(Continued)

OTHER PUBLICATIONS

Korean Office Action dated Jun. 20, 2017 form the corresponding Korean Application No. 10-2016-0001689, 6 pp.
(Continued)

*Primary Examiner* — Jorge Leon, Jr.
(74) *Attorney, Agent, or Firm* — Brinks Gilson & Lione

(57) ABSTRACT

The present disclosure provides a hydraulic control valve for a valve timing adjusting device of an engine. The valve timing adjusting device has a hydraulic control valve; a housing; a rotor installed in the housing and having vanes forming advance, retard and locking chambers, respectively; and a locking pin member elastically installed at the locking
(Continued)

chamber. In particular, the hydraulic control valve includes: a valve body connected to the camshaft and having ports and a spool space; an outer spool elastically installed in the spool space and having distribution ports selectively communicated with or disconnected to the ports of the valve body; and an inner spool that is integrally coupled to the outer spool and forms a supply passage connected to a working fluid pump and a drain passage connected to a drain tank together. With this arrangement, the hydraulic control valve reliably provides phase angle control operation and the self-locking operation to adjust a valve timing and thereby improving engine performance.

8 Claims, 9 Drawing Sheets

(52) U.S. Cl.
CPC ..... *F01L 2001/3443* (2013.01); *F01L 2001/34433* (2013.01); *F01L 2001/34453* (2013.01); *F01L 2001/34463* (2013.01); *F01L 2001/34469* (2013.01); *F01L 2001/34483* (2013.01); *F01L 2250/02* (2013.01); *F01L 2250/04* (2013.01)

(58) Field of Classification Search
USPC ..... 123/90.17
See application file for complete search history.

(56) References Cited

U.S. PATENT DOCUMENTS

| | | | | |
|---|---|---|---|---|
| 2013/0104820 | A1* | 5/2013 | Watanabe | F01L 1/3442 123/90.15 |
| 2013/0180481 | A1 | 7/2013 | Kato et al. | |
| 2016/0024978 | A1* | 1/2016 | Lichti | F01L 1/34409 123/90.15 |
| 2016/0230614 | A1* | 8/2016 | Scheidig | F01L 1/3442 |
| 2017/0022854 | A1* | 1/2017 | Takada | F01L 1/3442 |
| 2017/0130617 | A1* | 5/2017 | Haltiner, Jr. | F01L 1/3442 |

FOREIGN PATENT DOCUMENTS

| | | | |
|---|---|---|---|
| JP | 2000-002104 | A | 1/2000 |
| JP | 2000-179310 | A | 6/2000 |
| JP | 2001-050016 | A | 2/2001 |
| JP | 2002-357105 | A | 12/2002 |
| JP | 2010-285986 | A | 12/2010 |
| JP | 2012-057487 | A | 3/2012 |
| JP | 2013-155612 | A | 8/2013 |
| KR | 10-2010-0132923 | A | 12/2010 |
| KR | 10-2012-0032510 | A | 4/2012 |

OTHER PUBLICATIONS

Non-Final Office Action dated Jul. 12, 2018 from the corresponding U.S. Appl. No. 15/449,290, 9 pages.

* cited by examiner

CONTROL VALVE FOR VALVE TIMING ADJUSTING DEVICE OF INTERNAL COMBUSTION ENGINE

CROSS REFERENCE TO RELATED APPLICATION

The present application claims priority to and the benefit of Korean Patent Application No. 10-2016-0014902, filed on Feb. 5, 2016, which is incorporated herein by reference in its entirety.

FIELD

The present disclosure relates to a control valve for a valve timing adjusting device of an internal combustion engine.

BACKGROUND

The statements in this section merely provide background information related to the present disclosure and may not constitute prior art.

In general, an internal combustion engine (hereafter, referred to as an "engine") is equipped with a valve timing adjustment apparatus that can change timing of intake valves and discharge valves (e.g., exhaust valves), depending on the operation state of the engine. Such a valve timing adjustment apparatus adjusts the timing of intake valves or discharge valves by changing a phase angle according to the displacement or rotation of a camshaft connected to a crankshaft.

In general, a vane type valve timing adjustment apparatus that includes a rotor having a plurality of vanes freely rotated by working fluid in a housing is generally used.

The vane type valve timing adjustment apparatus adjusts valve timing using a difference in rotational phase generated due to relative rotation in an advance direction or a retard direction of a rotor that is rotated through vanes operated by the pressure of working fluid to an advance chamber or a retard chamber between a full advance phase angle and a full retard phase angle.

We have discovered that a positive torque is generated by friction due to rotation of a cam in opposite direction to the rotational direction of the cam. Meanwhile, a negative torque is generated by restoring force of a valve spring in the same direction as the rotational direction of the cam when a valve starts closing, and the negative force is smaller than the positive torque.

SUMMARY

The present disclosure provides a control valve for a valve timing adjusting device of an internal combustion engine capable of reliably implementing self-locking and unlocking operation by adopting a configuration built in a rotor and having low working fluid loss and improving engine performance through adjusting valve timing.

In one form of the present disclosure, a hydraulic control valve configured to selectively supply working fluid to or discharge from a valve timing adjusting device of an internal combustion engine. The valve timing adjusting device includes: a housing working in cooperation with a crankshaft and having an inner space; a rotor installed in the inner space of the housing and configured to work in cooperation with the camshaft, the rotor having a plurality of vanes forming an advance chamber in a direction of adjusting an advance phase angle and a retard chamber in a direction of adjusting a retard phase angle, respectively; and a locking pin member elastically installed at a locking chamber formed at the vanes to adjust a valve timing in a middle position between a most advance position and a most retard position of the rotor to inhibit or prevent the relative rotation of the rotor to the housing. In particular, the hydraulic control valve includes: a valve body connected to the camshaft and having a plurality of ports and a spool space formed therein; an outer spool elastically installed in the spool space of the valve body and having a plurality of distribution ports formed through an exterior circumference thereof to be selectively communicated with or disconnected to the ports of the valve body; and an inner spool integrally coupled at the inside of the outer spool and configured to form a supply passage connected to a working fluid pump and a drain passage connected to a drain tank together with the outer spool, respectively.

The rotor may include an advance fluid passage communicated with the advance chamber; a retard fluid passage communicated with the retard chamber; and a locking fluid passage communicated with a locking chamber.

The plurality of ports of the valve body may include an advance port communicated with the advance fluid passage of the rotor; a retard port communicated with the retard fluid passage; and a locking port communicated with the locking fluid passage.

The locking port of the valve body may be arranged between the advance port and the retard port.

The plurality of distribution ports of the outer spool may include a first distribution port connected or disconnected to the advance port of the valve body; a second distribution port connected or disconnected to the retard port of the valve body; and a third distribution port connected or disconnected to the locking port of the valve body.

The distribution ports of the outer spool may be configured such that the first distribution port and the second distribution port are disposed on both sides of the third distribution port.

The outer spool and the inner spool may form a spool of one body, and a spring may be arranged between the spool of the one body and an inner wall of the spool space.

A stopper limiting the movement of the spool may be further provided at one end portion of the valve body.

A check valve may be further provided at a working fluid inflow port of the valve body.

A bias spring may be provided at one end portion of the valve body and configured to apply elastic force to the camshaft.

The hydraulic control valve may include: an inflow port to which working fluid is supplied; an advance port communicating with the advance fluid passage; a retard port communicating with the retard fluid passage; a locking port communicating with the locking passage; and a discharge port discharging the working fluid. In particular, the hydraulic control valve may form a 5-port 5-position solenoid valve configured to select from a self-locking state to a filling state, an advance control state, a holding state, and a retard control state sequentially based on the movement of the spool against the elastic force of the spring arranged between an inner wall of the spool space and at least one of the inner spool or the outer spool.

The present disclosure having the above-described structure may improve engine performance by reliably implementing phase angle control operation and self-locking operation to adjust the valve timing through the ports of the outer spool and the inner spool configured to selectively and exactly communicate with the ports of the valve body and the flow passage of the rotor by control signals of a control unit depending on engine driving conditions in order for working fluid to be supplied to an advance chamber, a retard chamber and a locking pin chamber of the rotor.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
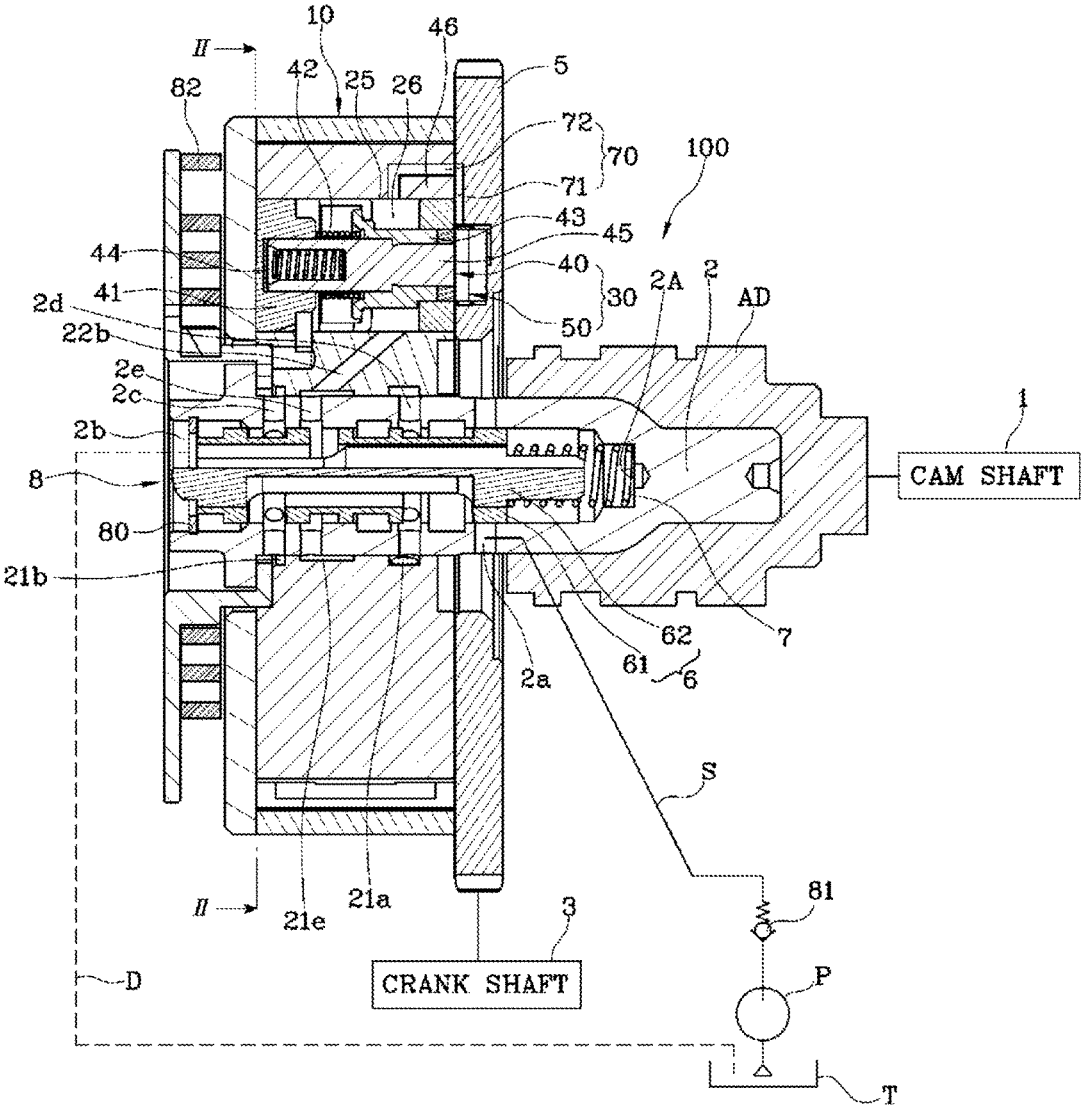
FIG. 1 is a block diagram showing an approximate configuration of a valve timing adjusting device provided with a hydraulic control valve.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, a valve timing adjusting device and adjusting method of an internal combustion engine in one form of the present disclosure will be described in detail. The relative dimensions and positional relationships of the components are showed to be artificially combined or magnified or exaggerated for better comprehension and ease of description.

FIG. 1 shows an approximate configuration of a valve timing adjusting device 100 provided with a hydraulic control valve in one form of the present disclosure.

The valve timing adjusting device 100 may include a valve body 2 extendedly formed to connect with a camshaft 1 of an internal combustion engine, an external circumference of the valve body 2 may be rotatably coupled to a sprocket 4 connected with a crankshaft 3 via a chain or a timing belt (not shown), and a disk shaped latch plate 5 is integrally formed inside of the sprocket 4.

The valve body 2 may be coupled to the camshaft 1 via an adapter AD. Inside a spool space 2A of the valve body 2 is installed a hydraulic control valve 8 in which a spool 6 having a plurality of ports formed at an exterior circumference thereof is resiliently installed via a spring 7 in order to switch and control the flow of working fluid as the control signal of a control unit (not shown) is applied thereto.

The spool 6 is driven by a solenoid valve V that moves the spool 6 in a direction opposite to the direction in which the elastic force of the spring 7 acts in accordance with the control signal of the control unit. See FIG. 16.

The hydraulic control valve 8, as shown in FIG. 1, may be connected between a fluid pump P and a drain tank T via a supply passage S and a drain passage D to control the supply and discharge of working fluid to the valve timing adjusting device 100 of the present disclosure.

Figure 3:
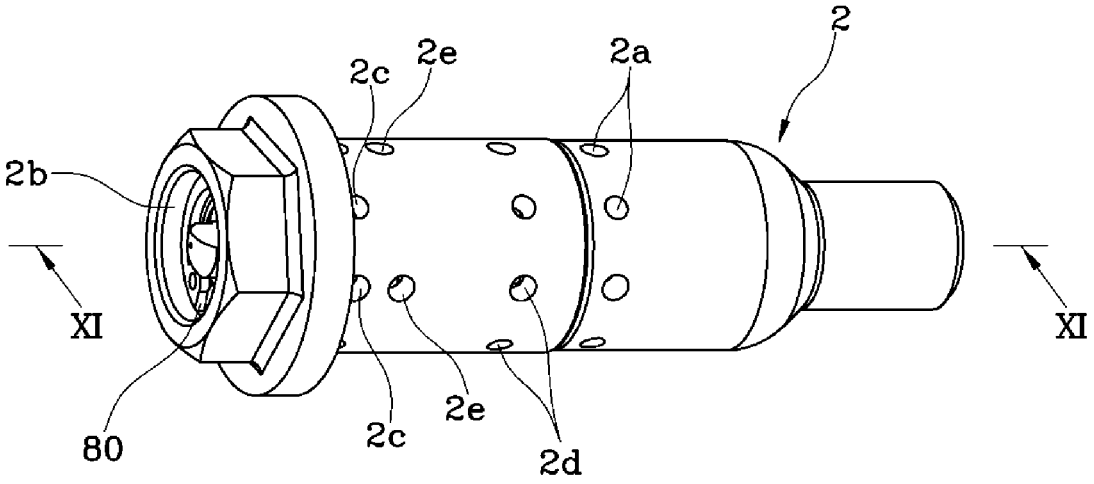
FIG. 3 is a perspective view showing the hydraulic control valve of FIG. 1.
Figure 4:
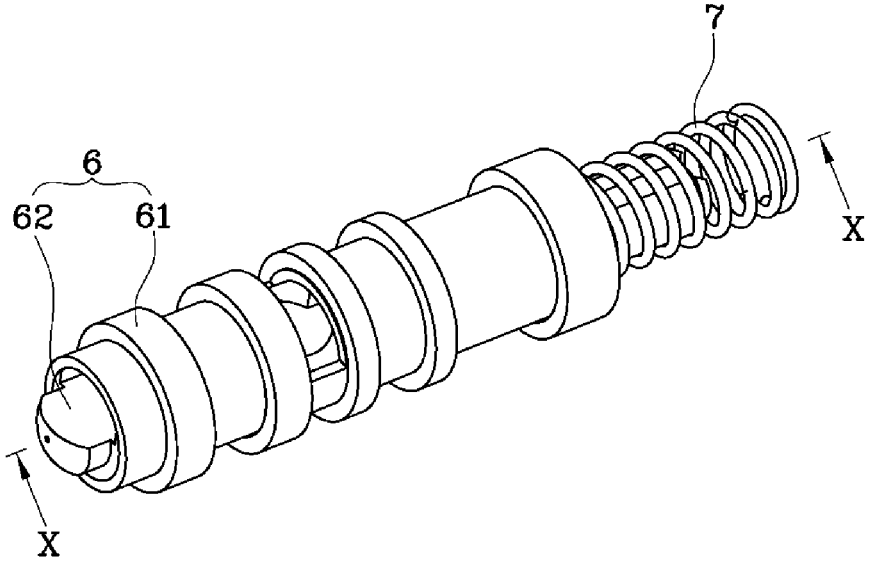
FIG. 4 shows the spool and spring with the valve body removed from FIG. 3.
Figure 5:
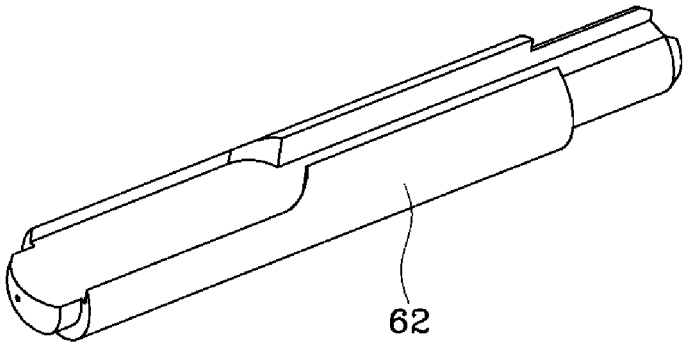
FIG. 5 shows the inner spool with the outer spool and the spring removed from FIG. 4.
Figure 6:
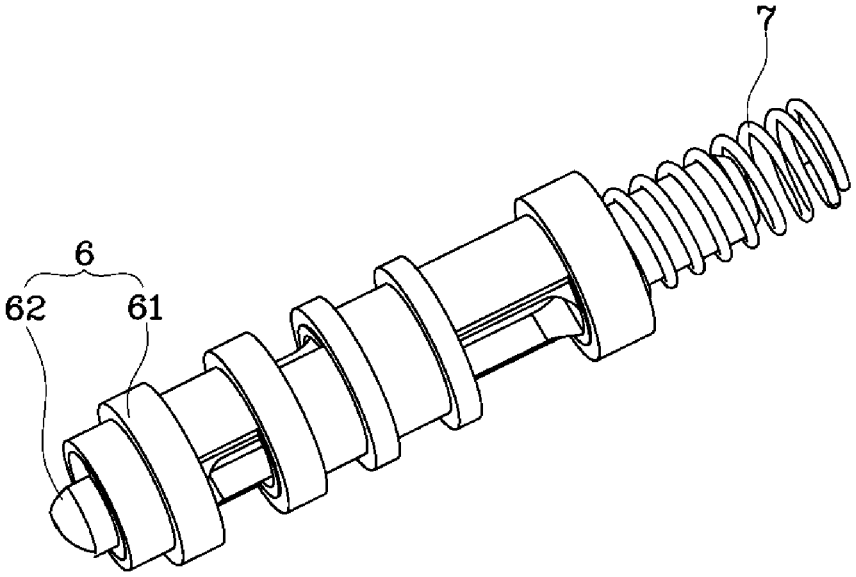
FIG. 6 is a view of the spool and spring of FIG. 4 taken at different angle.
Figure 7:
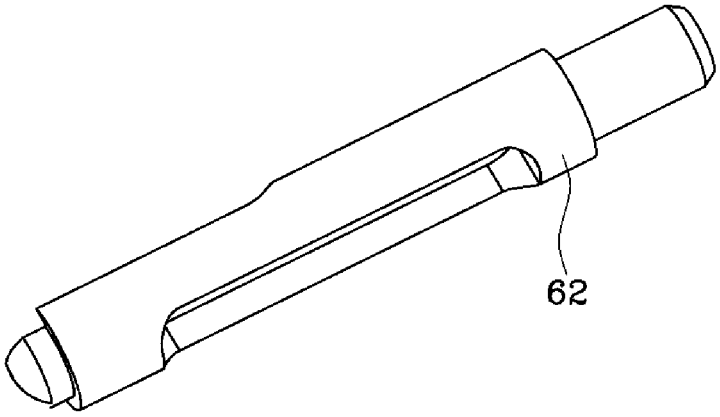
FIG. 7 shows the inner spool with the outer spool and the spring removed from FIG. 6.
Figure 8:
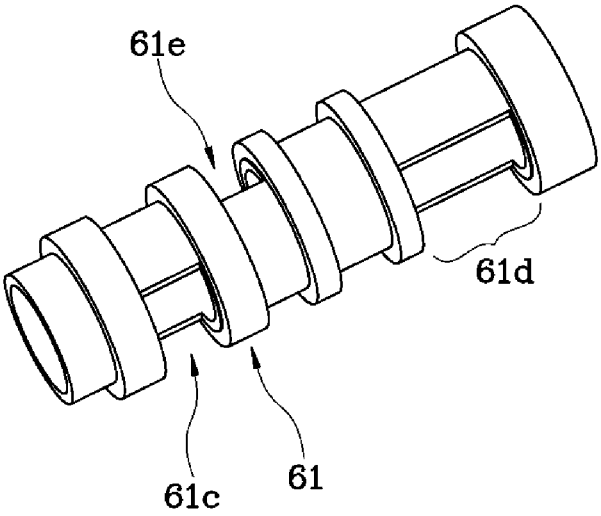
FIG. 8 shows the outer spool with the inner spool and the spring removed from FIG. 6.
Figure 9:
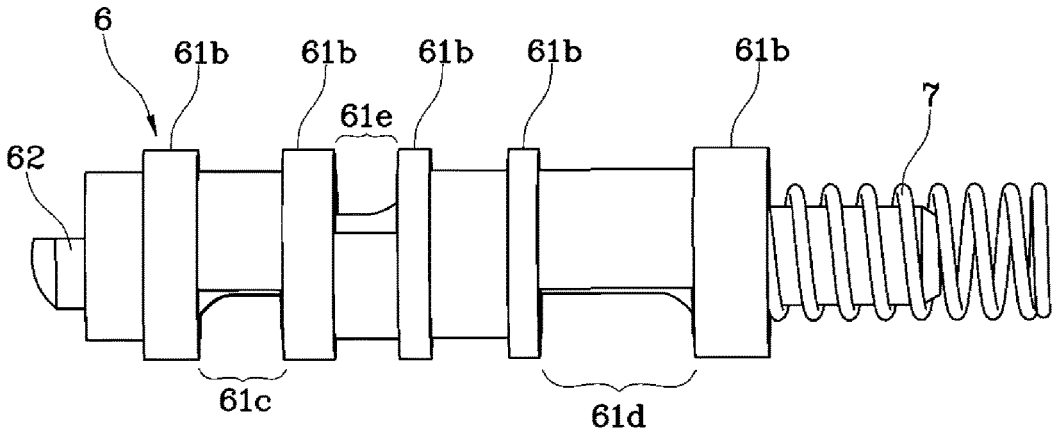
FIG. 9 is a side view of the spool and spring of FIG. 4.
Figure 10:
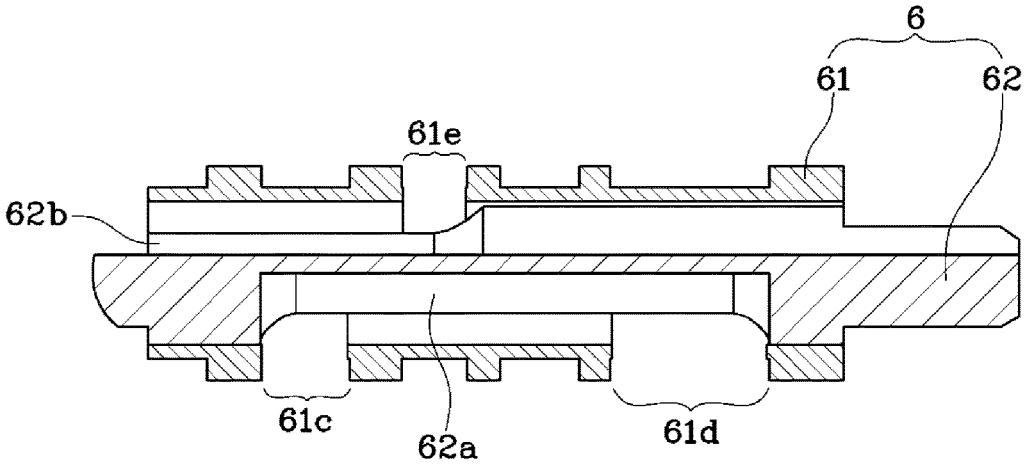
FIG. 10 is a sectional view taken along the line X-X of the spool of FIG. 4.

At the valve body 2 may be formed an inflow port 2*a* connected with the fluid pump P via the supply passage S, and as shown in FIG. 3, the left portion of the valve body 2 functions as a discharge port 2*b* connected to the drain tank T through a drain passage D.

Further, at valve body 2 may be formed an advance port 2*c* and retard port 2*d* connected with an advance chamber or a retard chamber described later, respectively, and a locking port 2*e* communicated with a locking chamber described later. In this regard, the locking port 2*e* may be disposed between the advance port 2*c* and the retard port 2*d*.

The spool 6 is integrally coupled with an outer spool 61 and an inner spool 62 internally coupled to the outer spool 61.

The spool 6 is inserted into the spool space 2A of the valve body 2 and one end of the spool 6 is applied with an elastic force by the spring 7 and the other end of the spool 6 is restricted by a stopper 80.

At an exterior circumference of the outer spool 61 is formed a first distribution port 61*c*, a second distribution port 61*d* and a third distribution port 61*e* partitioned by a plurality of protrusion portions 61*b* in order to be selectively communicated with or disconnected to the advance port 2*c* and the retard port 2*d* and the locking port 2*e* formed at the valve body 2.

The inner spool 62 may be coupled to the inside of the outer spool 61. The inner spool 62 forms a working fluid supply passage 62*a* connected with the inflow port 2*a* of the valve body 2 connected with the working fluid pump P, and a drain passage 62*b* connected with the discharge port 2*b* of the valve body 2 connected with the drain tank T together with the outer spool 61, respectively.

The valve body 2 is coupled to a cylinder shaped housing 10, a rotor 20 working in cooperation with the camshaft 1 and being coupled to be rotatable in the inner space of the housing 10; and rotation preventing means 30 making the rotor 20 to rotate with housing 10 by limiting the relative rotation of rotor 20 with respect to the housing 10.

At an interior circumference 11 of the housing 10 may be formed a plurality of protrusion portions 12 to be protruded at a predetermined interval. Sealing grooves 13 may be formed at an upper end portion of the protrusion portion 12 in the longitudinal direction of the housing 10, and a sealing seal 14 may be inserted into the sealing groove 13, respectively, to form a space 15 between the protrusion portions 12 adjacent to each other.

Figure 2:
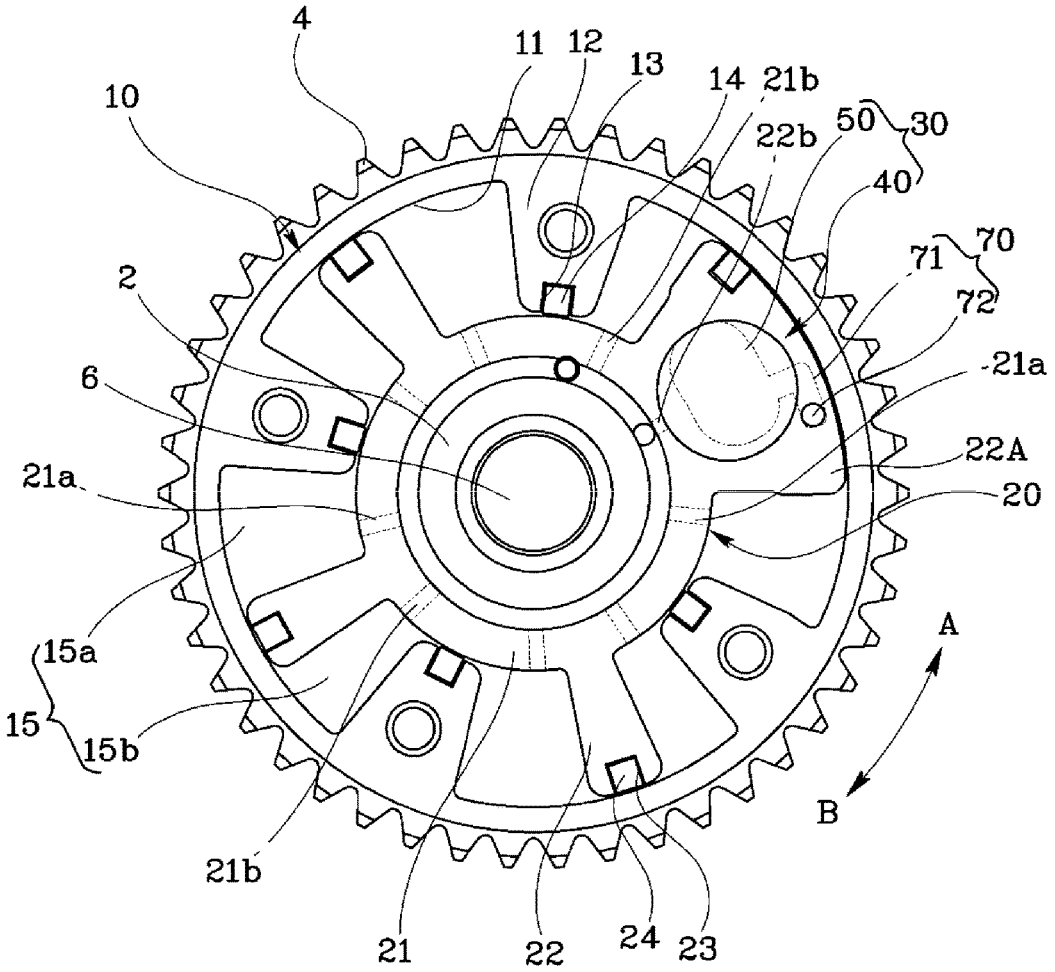
FIG. 2 is a front view along the II-II line of FIG. 1.

A plurality of vanes 22 may be formed, as shown in FIG. 2, at a boss portion 21 of the rotor 20 coupled with valve body 2 to be protruded toward the interior circumference 11 of the housing 10. A sealing groove 23 may be formed at an upper end portion of each vane 22 in the length direction, and a sealing seal 24 may be inserted into the sealing groove 23, respectively, to form a space 15 between protrusion portions 12 of housing 10 adjacent to each other.

The space 15, as shown in FIG. 2, may be partitioned with a retard chamber 15*a* in the arrow B direction (i.e., an advance direction) as the rotating direction of the camshaft 1 and an advance chamber 15*b* in the arrow A direction (i.e., a retard direction) around the vane 12.

At the boss portion 21 of the rotor 20 may be formed, respectively, an advance fluid passage 21*b* communicating with the advance port 2*c* and the advance chamber 15*b* of the valve body 2 to supply working fluid, a retard fluid passage 21*a* communicating with the retard port 2*d* and the retard chamber 15*a* of the valve body 2 to supply the working fluid, and a locking passage 22*b* communicating with locking port 2*e* of the valve body 2 and a locking chamber described later to supply the working fluid.

Therefore, if the working fluid is selectively supplied to the advance chamber 15*b* or the retard chamber 15*a* through the advance fluid passage 21*b* or the retard fluid passage 21*a* and then works to the vane 12 as fluid pressure, the rotor 20 may adjust an advance phase while rotates with respect to the housing 10 in the arrow B direction (advance direction) or adjust a retard phase while rotates in the arrow A direction (retard direction) on the contrary so that the valve timing of the intake valve or the discharge valve is adjusted.

The rotation preventing means 30 may be provided for emergency operation inhibiting or preventing relative rotation between the rotor 20 and the housing 10 by external causes and working in cooperation with each other during the rotor 20 freely rotates relative to the housing 10 and adjusts the phase.

That is, the rotation preventing means 30, as shown in FIG. 2, may be installed at anyone of the vanes 12 in the exemplary form of the present disclosure. In this regard, for better comprehension and ease of description, the vane 22 provided with the rotation preventing means 30 may be labeled 22A in order to distinguish from other vane 22.

The rotation preventing means 30, as shown in FIG. 1 or FIG. 2, may include a locking pin member 40 inserted into a mounting hole 25 formed through the vane 22A and a plurality of locking grooves 50 formed at the latch plate 5 to be coupled to and locked with a locking pin member 40 or to be release.

The locking pin member 40 may include an upper cap 41 closing an one end portion (a left end portion in FIG. 1) of mounting hole 25 of the vane 22A, an outer pin 43 having hollow cylinder shape installed at a lower end portion of the upper cap 41 to be resiliently supported via an outer spring 42, and an inner pin 45 slidably coupled to the inside of the outer pin 43 and installed to be resiliently supported via an inner spring 44 with respect to the upper cap 41.

The locking pin member 40 may further include a ring shaped lower cap 46 installed at the other end portion (a right end portion in FIG. 1) of the mounting hole 25 and supporting an exterior circumference of the outer pin 43.

At the vane 22A may be formed a penetrative locking passage 22*b* supplying the working fluid to the locking chamber 26 around the outer pin 43 in the mounting hole 25 and discharging the working fluid therefrom.

The plurality of locking grooves 50 formed at the latch plate 5 composing the rotation preventing means 30 may be formed in a plurality of numbers having different diameters and different depths and connected to each other in order to face the mounting hole 25 of the vane 22A.

Further provided may be a drain passage 70 discharging the working fluid of the locking groove 50 outside when the locking pin member 40 is locked. As shown in FIGS. 1 and 2, a drain passage 70 may include a first drain hole 71 formed at the latch plate 5 in order to communicate with the locking groove 50 and a second drain hole 72 connected with the first drain hole 71 and passing through the vane 22A to be connected to the locking chamber 26.

However, the sizes and the relative positions of the locking groove 50, the first drain hole 71 and the second drain hole 72 shown in FIG. 1 and FIG. 2 are artificially combined and enlarged or exaggerated for better comprehension and ease of description on mutual communication relationship depending on the operation of the locking pin member 40 unlike the actual device scale or section view.

A check valve 81 may be further provided at the working fluid inflow port 2*a* of the valve body.

A bias spring 82 applying an elastic force to the camshaft 1 may be provided at one end portion of the valve body 2 in one exemplary form of the present disclosure.

Hereinafter, the operations of the valve timing adjusting device in one exemplary form of the present disclosure will be described.

In the case that the valve timing adjusting device is moved to a predetermined position without extra control to improve engine starting performance in a state of an engine being stopped or an engine starting or emergency situation of control impossibility occurs during an engine is operated, the locking pin member 40 should be self-locked without extra control so that the relative rotation of the rotor 20 with respect to housing 10 is inhibited or prevented.

Figure 11:
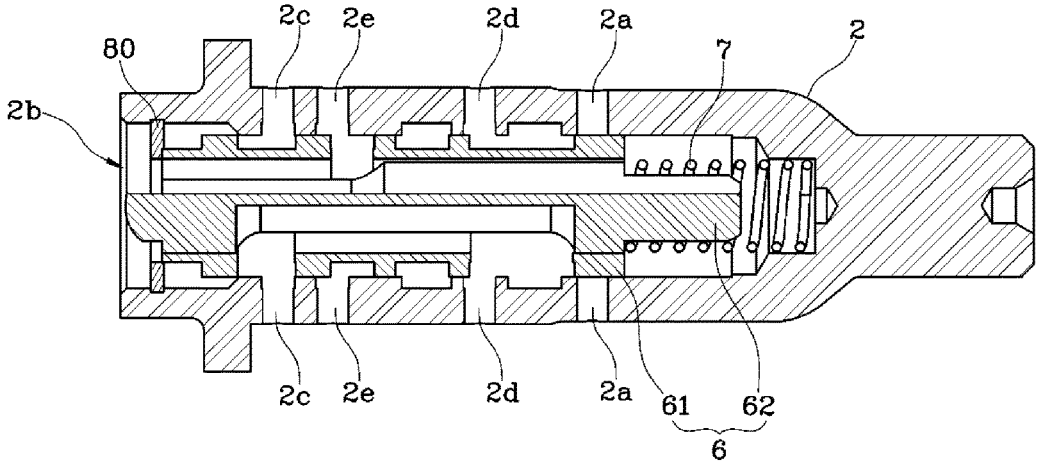
FIG. 11 is a sectional view taken along line XI-XI of the hydraulic control valve of FIG. 3, showing a self-locking state.

In the case that the engine is stopped or should be emergency stop, the hydraulic control valve 8 may be placed in a self-locking state as shown in FIG. 11 by the elastic force of the spring 7. The inflow port 2*a* connected to the supply passage S of the fluid pump P is blocked, and the working fluid filled in the advance chamber 15*b*, the retard chamber 15*a* and the locking chamber 26 may pass through the flow passages 21*a*, 21*b* and 22*b* of the rotor 20, the port 2*c*, 2*d* and 2*e* of the valve body 2, and the drain passage 62*b* of the inner spool 62 to be discharged to the drain tank T along the drain passage D.

Therefore, the outer pin 43 and the inner pin 45 descend by the elastic force of the springs 42 and 44 because the applying force of the working fluid is released so that the lower ends portion thereof are tightly contacted on the surface of the latch plate 5.

In this state, the negative torque (or positive torque) is transferred to the vane 22A through the camshaft 1 and the rotor 20, sequentially so that the vane 22A rotates toward the advance direction (B direction) or the retard direction (A direction). Therefore, the inner pin 45 and the outer pin 43 are sequentially descended by the elastic force of the springs 44 and 42 to be sequentially inserted into the locking groove 50.

Accordingly, the vane 22A is in locked state that it cannot move in either the retard direction or the advance direction. Therefore, the locking pin member 40 is strongly coupled to the locking groove 50 of the latch plate 5 so that the rotor 20 cannot relatively rotate with respect to the housing 10 and rotate with it.

In the self-locking operation, a part of working fluid filled in the locking groove 50 is discharged outside through the drain passage 70, that is, the first and second drain holes 71 and 72, and the locking chamber 26, thereby not working as a resistance to the locking operation.

Figure 12:
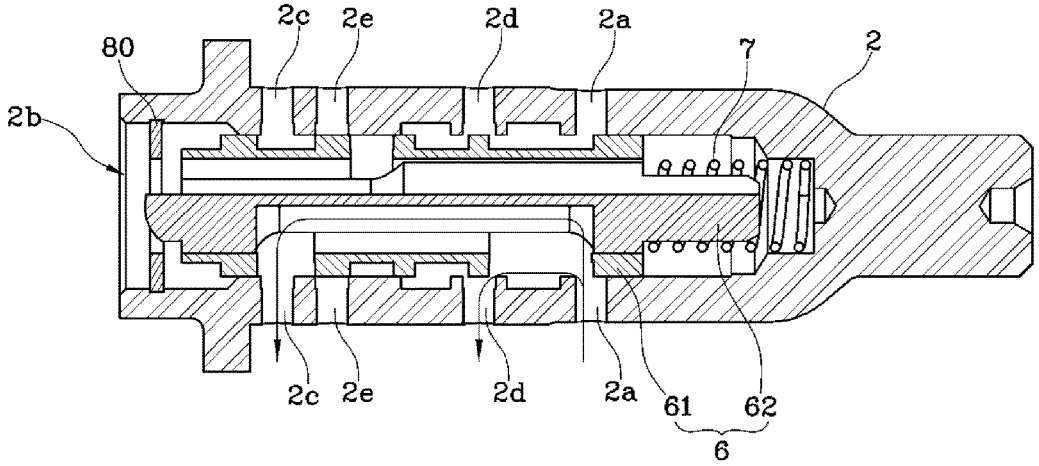
FIG. 12 is a view showing a filling state in which the hydraulic control valve of FIG. 11 fills the working fluid in the advance chamber and the retard chamber.

Meanwhile, in the case that the engine idly rotates after a predetermined time has elapsed since the engine was started, the hydraulic control valve 8 may move to a filling state of FIG. 12 by control signal of the control unit.

This is the stabilizing state at initial engine starting and charges the working fluid into the advance chamber 15*b* and the retard chamber 15*a*.

At this time, the hydraulic control valve 8 makes the working fluid flowed into through the inflow port 2*a* from the fluid pump P to supply to the advance chamber 15*b* through the supply passage 62*a*, the first distribution port 61*c*, the advance port 2*c* and the advance fluid passage 21*b* and to supply to the retard chamber 15*a* through the supply passage 62*a*, the second distribution port 61*d*, the retard port 2*d* and the retard fluid passage 21*a*.

Meanwhile, in the case that the engine starts to be normally operated, as the valve timing of the intake valve or the discharge valve should be adjusted, the locking state of the locking pin member 40 should be released.

Figure 13:
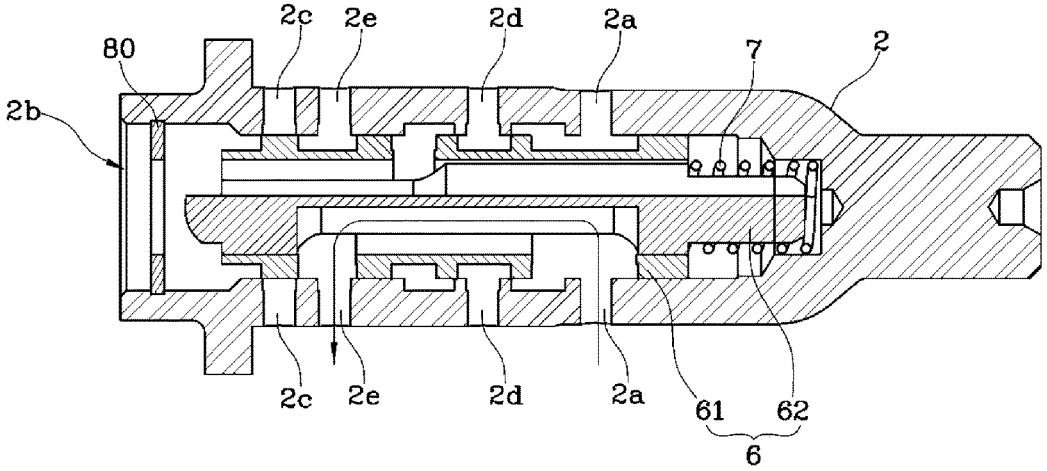
FIG. 13 is a view showing a holding state of the hydraulic control valve of FIG. 11.

For this purpose, the hydraulic control valve 8 is switched to a holding state of FIG. 13 by the control signal of the control unit. Therefore, the working fluid flowed into through the inflow port 2*a* from the fluid pump P is supplied to the locking chamber 26 through the supply passage 62*a*, the third distribution port 61*e*, the locking port 2*e*, and the locking passage 22*b*.

Accordingly, the outer pin 43 and the inner pin 45 compress the springs 42 and 44 to be raised to the maximum toward to the upper cap 41 by the pressure of the working fluid supplied to locking chamber 26. At this time, the lower end portions of the inner pin 45 and the outer pin 43 are lifted from the surface of the latch plate 5.

Therefore, the vane 22A provided with the locking pin member 40 allows the relative rotation of the rotor 20 relative to the housing 10 so that the valve timing of the intake valve or the exhaust valve can be adjusted.

Figure 14:
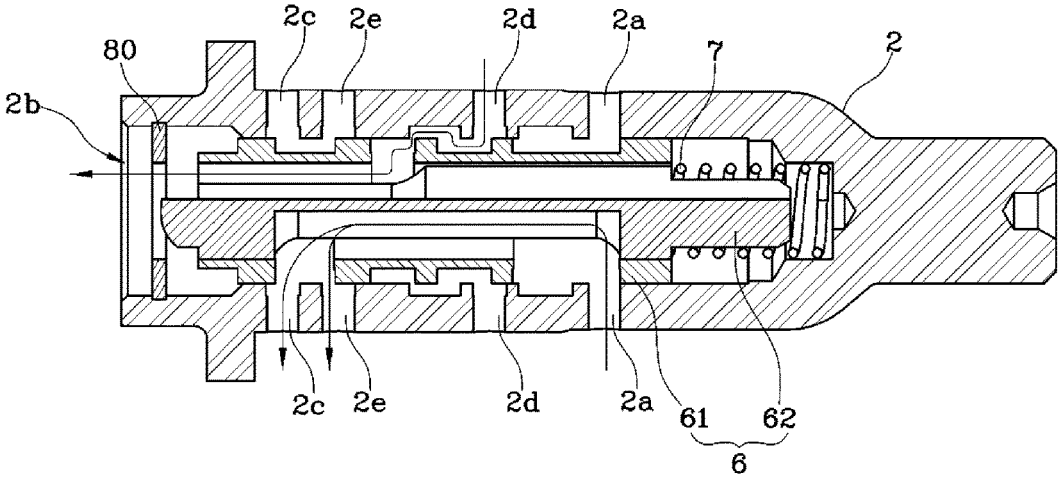
FIG. 14 is a view showing an advance control state of the hydraulic control valve of FIG. 11.

If the hydraulic control valve 8 is switched to an advance control state of FIG. 14 by the control signal of the control unit, the advance control operation is started.

In the state the working fluid is supplied to the locking chamber 26 from the fluid pump P, the working fluid flowed into through the inflow port 2*a* is supplied to the advance chamber 15*b* through the first distribution port 61*c*, the advance port 2*c* and the advance fluid passage 21*b*. At this time, the working fluid filled in the retard chamber 15*a* may be discharged to the drain tank T through the retard fluid passage 21*a*, the second distribution port 61*d* and the drain passage 62*b*.

Therefore, corresponding to the negative torque or the positive torque through the camshaft 1, the vane 22 is freely controlled with respect to the housing 10 in the advance direction (B direction) or in the retard direction (A direction) to adjust the valve timing of the intake valve or the discharge valve via the camshaft 1.

Figure 15:
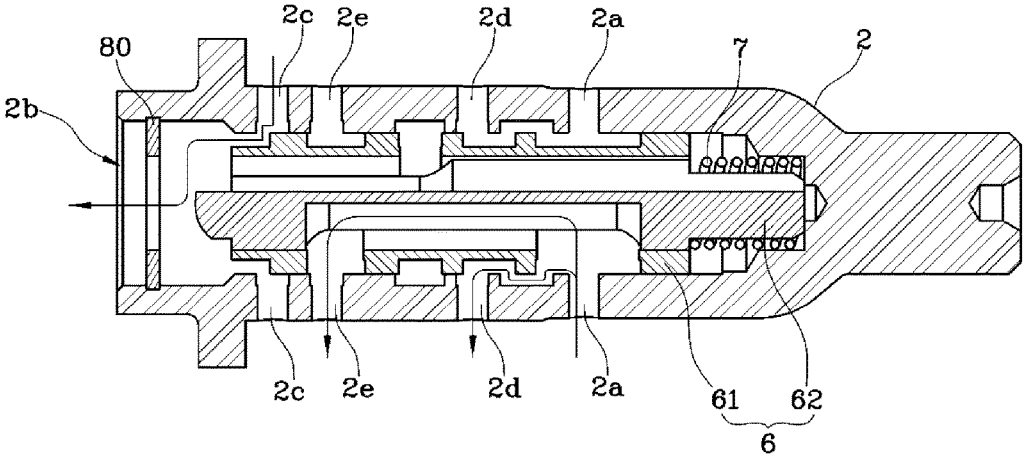
FIG. 15 is a view showing a retard control state of the hydraulic control valve of FIG. 11.

Meanwhile, if the hydraulic control valve 8 is switched to a retard control state of FIG. 15 by the control signal of the control unit, the retard control operation is started.

In the state that the working fluid is supplied to the locking chamber 26 from the fluid pump P, the working fluid flowed into through the inflow port 2*a* is supplied to the retard chamber 15*a* through the second distribution port 61*d*, the retard port 2*d* and the retard fluid passage 21*a*. At this time, the working fluid filled in the advance chamber 15*b* may be discharged to the drain tank T through the advance fluid passage 21*b*, a gap between the outer spool 61 and the valve body 2, and the discharge port 2*b*.

Therefore, corresponding to the negative torque or the positive torque through the camshaft 1, the vane 22 is freely controlled with respect to the housing 10 in the advance direction (B direction) or in the retard direction (A direction) to adjust the valve timing of the intake valve or the discharge valve via the camshaft 1.

Figure 16:
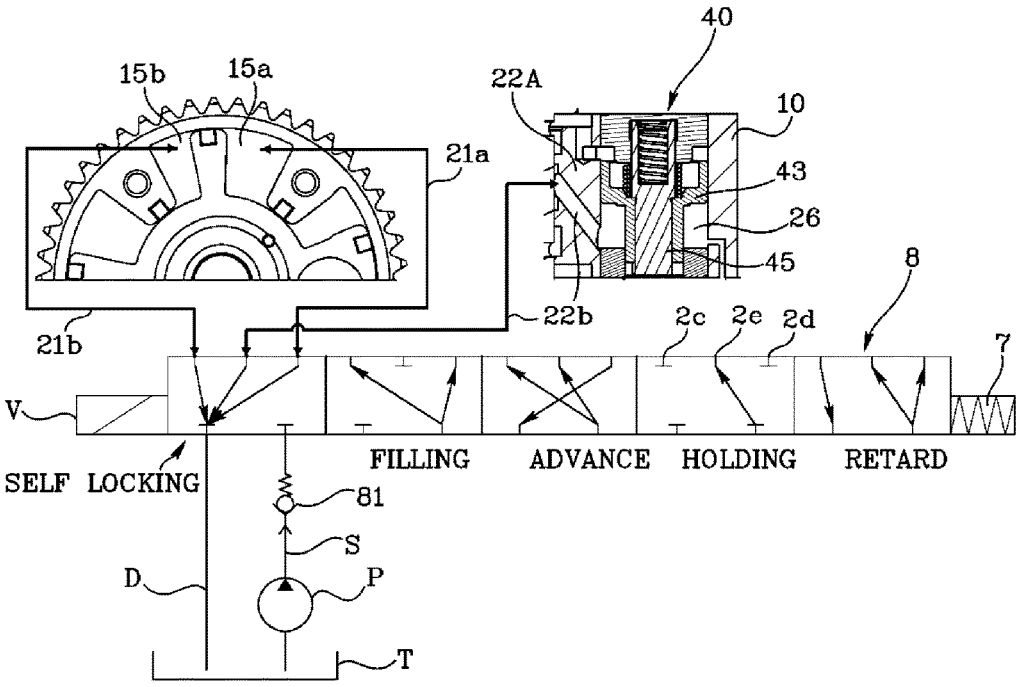
FIG. 16 is a diagram of a valve timing adjusting device in which the hydraulic control valve is indicated by a symbol.

Referring to FIG. 16, the hydraulic control valve 8 described above may be summarized as follows. The hydraulic control valve 8 includes an inflow port 2*a* to which working fluid is supplied and an advance port 2*c* communicating with the advance fluid passage 21*b*, a retard port 2*d* communicating with the retard fluid passage 21*a*, a locking port 2*e* communicating with the locking passage 22*d*, and a discharge port 2*b* discharging the working fluid, and forms a 5-port 5-position solenoid valve selecting from the self-locking state to the filling state, the advance control state, the holding state, and the retard control state sequentially according to the moving of the spool 6 against the elastic force of the spring 7.

As described above, in an exemplary form of the present disclosure, the hydraulic control valve is built-in the rotor so that the loss of the working fluid can be reduced, and the hydraulic control valve having various control position is adopted so that it is able to implement the locking and unlocking operations and adjust the valve timing with accurate responsibility and high reliability and, thereby improving the engine performance.

Although the exemplary forms of the present disclosure have been disclosed for illustrative purposes, those skilled in the art will appreciate that various modifications, additions and substitutions are possible, without departing from the scope and spirit of the present.

What is claimed is:

1. A hydraulic control valve for a valve timing adjusting device of an internal combustion engine to selectively supply working fluid to or discharge from the valve timing adjusting device having a housing having an inner space, a rotor installed in the inner space of the housing and configured to work in cooperation with a camshaft, the rotor having a plurality of vanes forming an advance chamber in a direction of adjusting an advance phase angle and a retard chamber in a direction of adjusting a retard phase angle, respectively, and a locking pin member elastically installed at a locking chamber formed at the plurality of vanes to adjust a valve timing in a middle position between a most advance position and a most retard position of the rotor to inhibit or prevent a relative rotation of the rotor to the housing, the hydraulic control valve comprising:

a valve body connected to the camshaft and having a plurality of ports and a spool space formed therein;

an outer spool elastically installed in the spool space of the valve body and having a plurality of distribution ports formed through an exterior circumference thereof to be selectively communicated with or disconnected to the plurality of ports of the valve body;

an inner spool integrally coupled at an inside of the outer spool and configured to form a supply passage connected to a working fluid pump and a drain passage connected to a drain tank together with the outer spool, respectively;

wherein the rotor comprises:

an advance fluid passage configured to communicate with the advance chamber, a retard fluid passage configured to communicate with the retard chamber, and a locking fluid passage configured to communicate with the locking chamber;

an inflow port to which working fluid is supplied;

an advance port configured to communicate with the advance fluid passage;

a retard port configured to communicate with the retard fluid passage;

a locking port configured to communicate with the locking fluid passage; and a discharge port configured to discharge the working fluid, and wherein the hydraulic control valve forms a 5-port 5-position solenoid valve configured to select from a self-locking state to a filling state, an advance control state, a holding state, and a retard control state sequentially based on a movement of the spool against an elastic force of a spring arranged between an inner wall of the spool space and at least one of the inner spool or the outer spool.

2. The hydraulic control valve of claim 1, wherein the locking port of the valve body is arranged between the advance port and the retard port.

3. The hydraulic control valve of claim 1, wherein the plurality of distribution ports of the outer spool comprises:

a first distribution port configured to be connected or disconnected to the advance port of the valve body;

a second distribution port configured to be connected or disconnected to the retard port of the valve body; and a third distribution port configured to be connected or disconnected to the locking port of the valve body.

4. The hydraulic control valve of claim 3, wherein the first distribution port and the second distribution port are disposed on a first side and a second side of the third distribution port, respectively.

5. The hydraulic control valve of claim 1, wherein the outer spool and the inner spool form a spool of one body, and a spring is arranged between the spool of one body and an inner wall of the spool space.

6. The hydraulic control valve of claim 1, wherein a stopper configured to limit a movement of the spool is further provided at one end portion of the valve body.

7. The hydraulic control valve of claim 1, wherein a check valve is further provided at a working fluid inflow port of the valve body.

8. The hydraulic control valve of claim 1, wherein a bias spring is provided at one end portion of the valve body and is configured to apply elastic force to the camshaft.

* * * * *